US012532948B2

(12) United States Patent
Hillaert et al.

(10) Patent No.: US 12,532,948 B2
(45) Date of Patent: Jan. 27, 2026

(54) LUGGAGE ARTICLE INCLUDING A BURST RESISTANT RIM

(71) Applicant: Samsonite IP Holdings S.a r.l., Luxembourg (LU)

(72) Inventors: Rik Hillaert, Oudenaarde (BE); Wim De Vos, Zingem (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 314 days.

(21) Appl. No.: 16/669,763

(22) Filed: Oct. 31, 2019

(65) Prior Publication Data

US 2020/0128931 A1 Apr. 30, 2020

(30) Foreign Application Priority Data

Oct. 31, 2018 (EP) ..... 18203688

(51) Int. Cl.
*A45C 5/03* (2006.01)
*A45C 13/00* (2006.01)
*A45C 13/10* (2006.01)

(52) U.S. Cl.
CPC ..... *A45C 5/03* (2013.01); *A45C 13/005* (2013.01); *A45C 13/10* (2013.01); *A45C 2005/037* (2013.01)

(58) Field of Classification Search
CPC ..... A45C 5/03; A45C 13/005; A45C 13/10; A45C 2005/037
See application file for complete search history.

(56) References Cited

U.S. PATENT DOCUMENTS 1,772,981 A * 8/1930 Berger-Stalder ..... A45C 13/008 190/28
1,811,718 A * 6/1931 Hofbauer ..... A45C 13/008 190/28
4,094,392 A 6/1978 Gregg et al.
4,509,622 A * 4/1985 Morszeck ..... A45C 13/10 190/119

(Continued)

FOREIGN PATENT DOCUMENTS

CN 203943205 U 11/2014
CN 103410820 B 9/2015

(Continued)

OTHER PUBLICATIONS

Extended European Search Report for European patent application No. 18203688.9, dated May 23, 2019, 6 pages.

*Primary Examiner* — Tri M Mai
(74) *Attorney, Agent, or Firm* — Dorsey & Whitney LLP

(57) ABSTRACT

Provided herein is a luggage article 100 that includes two opposing shells 110, 120 hingedly connected together along one edge, and having peripheral rims 210, 250 that abut together in a closed configuration. One of the shells may have a peripheral rim with a recess 220. The other shell may have a peripheral rim with a projecting flange 230, 260 that is engagable within the recess 220 when the case is closed. At least one of the shells 210, 250 may have a second peripheral projecting flange 210, 250 that is arranged to project beyond and be engaged behind a peripheral rim of the opposing shell. The second peripheral projecting flange may be limited to extending from a small portion or along discrete selected sections of the peripheral rim.

18 Claims, 6 Drawing Sheets

(56) References Cited

U.S. PATENT DOCUMENTS

| | | | | |
|---|---|---|---|---|
| 4,522,312 | A * | 6/1985 | Rathgeber | A45C 13/1084 292/249 |
| 5,111,920 | A | 5/1992 | Castelli et al. | |
| 5,407,038 | A | 4/1995 | Pedlar | |
| 5,458,718 | A | 10/1995 | Venkitachalam | |
| 5,755,311 | A | 5/1998 | Younessian et al. | |
| 5,894,914 | A | 4/1999 | Jubin | |
| 5,924,533 | A | 7/1999 | Cnockaert et al. | |
| 6,367,603 | B1 | 4/2002 | Tiramani et al. | |
| 7,451,872 | B1 | 11/2008 | Allen | |
| 7,540,364 | B2 | 6/2009 | Sanderson | |
| 8,434,794 | B2 * | 5/2013 | Sijmons | A45C 13/18 292/26 |
| 8,960,391 | B2 | 2/2015 | Roncato | |
| 2006/0042897 | A1 | 3/2006 | Sanderson | |
| 2015/0021132 | A1 * | 1/2015 | Sijmons | A45C 5/03 190/120 |
| 2018/0360181 | A1 * | 12/2018 | Morszeck | A45C 13/04 |

FOREIGN PATENT DOCUMENTS

| | | | |
|---|---|---|---|
| DE | 9201216.7 | U1 | 3/1992 |
| EP | 1867246 | A1 | 12/2007 |
| EP | 1799063 | A4 | 12/2012 |
| EP | 1867246 | B1 | 11/2014 |
| EP | 2826394 | A1 | 1/2015 |
| EP | 3170423 | A1 | 5/2017 |
| EP | 3646751 | A1 | 5/2020 |
| GB | 1236991 | A | 6/1971 |
| JP | S53109800 | A | 9/1978 |
| JP | H02-039378 | Y2 | 10/1990 |
| JP | 2008511384 | A | 4/2008 |
| JP | 3166866 | B2 | 3/2011 |
| JP | 3181440 | U | 2/2013 |
| TW | 201311177 | A | 3/2013 |
| WO | 9944807 | A1 | 9/1999 |
| WO | 2010029580 | A1 | 3/2010 |
| WO | 2011093984 | A1 | 8/2011 |
| WO | 2017082586 | A1 | 5/2017 |
| WO | 2017109010 | A1 | 6/2017 |

* cited by examiner

LUGGAGE ARTICLE INCLUDING A BURST RESISTANT RIM

CROSS-REFERENCE TO RELATED APPLICATION

This application claims priority to European Patent Application No. 18203688.9, filed Oct. 31, 2018, entitled "Luggage Article Including a Burst Resistant Rim", which is hereby incorporated by reference herein in its entirety for all purposes.

TECHNICAL FIELD

The present disclosure relates generally to luggage articles, and more specifically to a luggage article including a burst resistant rim.

BACKGROUND

Traditional luggage cases include a split construction with first and second shells or halves that are defined at a seam line defined along the minor faces of the case. For example, traditional luggage case configurations define the seam along top, bottom, left and right minor faces of the case. Along this seam location, each of the case halves have an interface for engaging the opposing case half. Traditional interfaces between the case halves provide insufficient protection from bursting particularly in the handle regions where forces tending to cause bursting are typically concentrated.

It is therefore desirable to provide an improved luggage case that addresses one or all of the above-described problems and/or which more generally offers improvements or an alternative to existing arrangements.

Documents that may be related to the present disclosure include EP2826394, CN103410820B, WO2010029580A1, EP1867246B1, U.S. Pat. No. 7,540,364B2, EP1799063, U.S. Pat. No. 6,367,603B1, WO1999044807A1, U.S. Pat. Nos. 5,755,311A, 5,924,533A, 5,894,914A, 5,458,718A, 5,407,038A, 5,111,920A, GB1236991A, CN203943205U, TW201311177A, U.S. Pat. No. 8,960,391 B2, WO2011093984A1, and U.S. Pat. No. 7,451,872B1.

SUMMARY

The present disclosure provides a luggage article that includes two opposing shells hingedly connected together along one edge, and having peripheral rims that abut together in a closed configuration that resists the burst tendency of the luggage. One of the shells may have a peripheral rim with a recess. The other shell may have a peripheral rim with a projecting flange that is engagable within the recess when the case is closed such that the peripheral rims are generally abutting or engaged with one another. At least one of the shells may have a second peripheral projecting flange that is arranged to project beyond and be engaged behind (i.e. inwardly relative to the luggage article) a peripheral rim of the opposing shell. The second peripheral projecting flange may be limited to extending from a small portion or along discrete selected sections of the peripheral rim.

In one example, a luggage case includes a first shell hingedly connected together with a second shell. Each of the first shell and second shells may have a first peripheral rim and a second peripheral rim respectively that abut together in a closed configuration. The first peripheral rim may include a slot recess, the second peripheral rim may include a first projecting flange that is engaged within the slot recess when the first shell and the second shell are in the closed configuration, and at least one of the first shell and second shell may include a second projecting flange that is arranged to project beyond and be engaged inwardly of the peripheral rim of the opposing shell.

Additionally or separately, the second projecting flange may be on the first shell.

Additionally or separately, the first projecting flange may extend around a majority of the second peripheral rim.

Additionally or separately, the first projecting flange may generally define a constant height.

Additionally or separately, the second projecting flange may project along a portion of the peripheral rim; and/or the second projecting flange may projects along a portion of a mid-point region of a long side of the peripheral rim; and/or the second projecting flange may project along a portion of a mid-point region of a short side of the peripheral rim; and/or the second projecting flange may project along a portion of the peripheral rim proximal to a carry handle of the case.

In another example, additionally or separately, the second projecting flange is disposed and projects more inwardly, relative to the case, than the first projecting flange.

In another example, additionally or separately, the second projecting flange may include an outwardly facing surface that is proximal to and faces a lateral side flange extending laterally inwardly from the second peripheral rim of the shell. Additionally or separately, the second projecting flange includes an outwardly facing surface that is proximal to and abuts the peripheral rim of the opposing shell.

In another example, the first peripheral rim and the second peripheral rim may each include lateral surfaces from which the flanges project generally perpendicularly.

Additionally or separately, in another example, the first peripheral rim may include a lateral surface into which the recess is formed, with the lateral surface opposing a generally parallel lateral surface formed on the second peripheral rim when in the closed configuration.

Additionally or separately in another example, the first peripheral rim may include a seal provided in a base of the recess and configured to abut the end of the first projecting flange when in the closed configuration.

In another example, additionally or separately, the first peripheral rim or the second peripheral rim may include discrete protrusions extending therefrom that are configured to engage in corresponding recesses defined in the other shell in the regions of at least one of locks or handles on the shells. Additionally, the discrete protrusions may extend from a surface of the rim as a part of the second projecting flange and are differentiated therefrom via an increased lateral thickness.

Additionally or separately, the first peripheral rim may include at least two generally parallel flanges extending inwardly from and around the first peripheral rim forming a C-shape that opens inwardly into the first shell.

Additionally or separately, the second peripheral rim may include at least two generally parallel flanges extending inwardly from and around the second peripheral rim forming a channel that opens inwardly into the second shell.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

DETAILED DESCRIPTION

Figure 1:
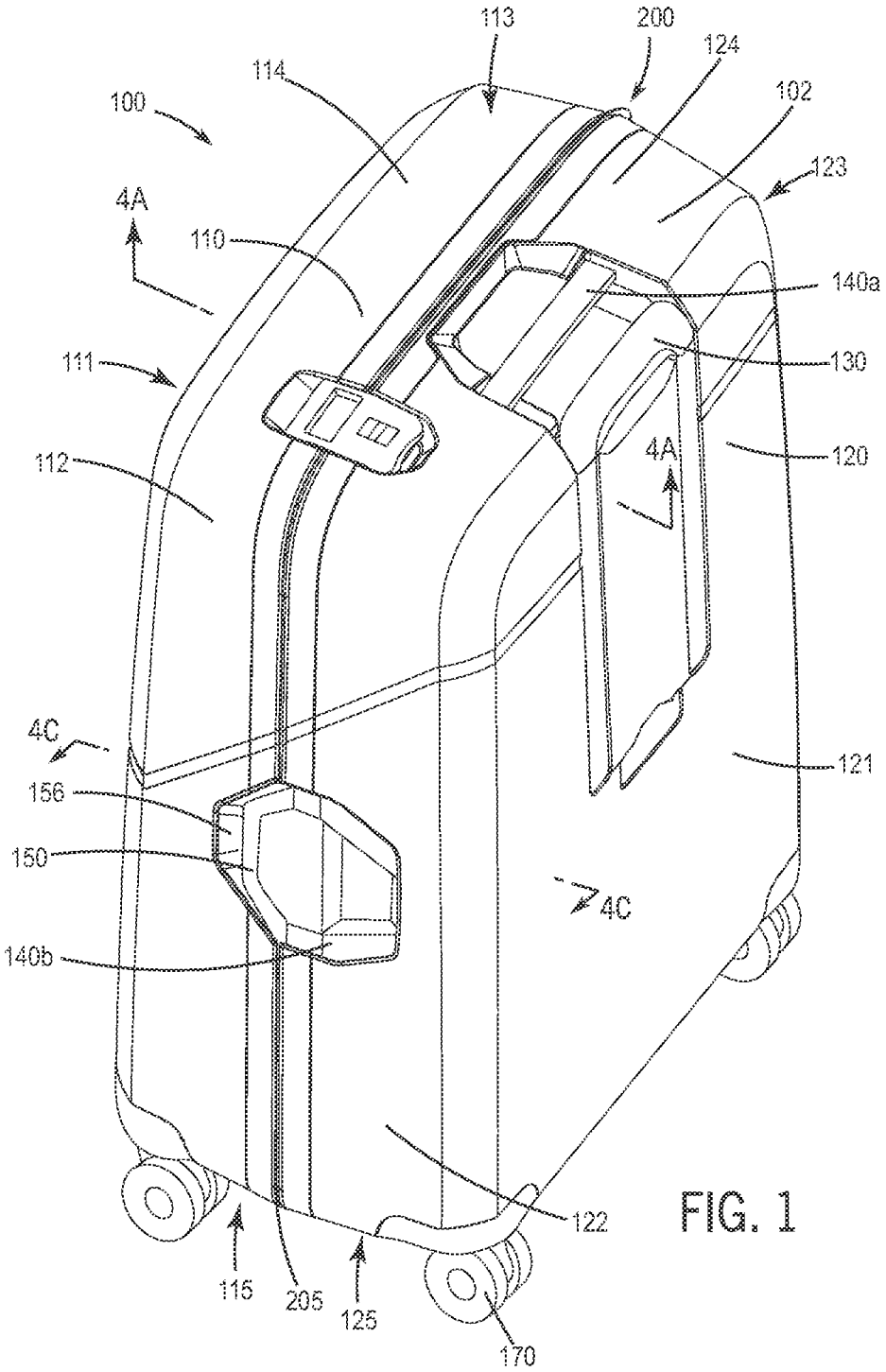
FIG. 1 is a rear isometric view of a luggage article according to some examples of the present disclosure.

According to the present disclosure, a luggage article includes two opposing shells hingedly connected together along one edge, and having peripheral rims that abut together in a closed configuration that resists the burst tendency of the luggage. One of the shells may have a peripheral rim with a recess. The other shell may have a peripheral rim with a projecting flange that is engagable within the recess when the case is closed such that the peripheral rims are generally abutting or engaged with one another. At least one of the shells may have a second peripheral projecting flange that is arranged to project beyond and be engaged behind (i.e. inwardly relative to the luggage article) a peripheral rim of the opposing shell. The second peripheral projecting flange may be limited to extending from a small portion or along discrete selected sections of the peripheral rim.

FIGS. 1-5B illustrate an exemplary luggage article 100 according to various examples, embodiments, and aspects of the present disclosure. The luggage article 100 includes a housing 102 formed from a plurality of walls or panels (hereinafter "panels" for the sake of convenience without intent to limit) defining an internal storage volume 104 in which to carry a user's belongings. In one example, the housing 102 may be formed from first and second shell portions 110, 120, which may be right and left shell portions or halves, respectively, may be sized similarly to each other, or one of the shell portions may be sized to include the storage volume 104. As shown, each of the first 110 and second shell portion 120 (hereafter may be referred to a first shell or second shell, respectively) may be defined by one or more panels of the luggage article 100. For example, the first shell portion 110 may be defined by the front major panel 111 and at least portions of the front, rear, top, and bottom panels 112, 113, 114, 115 of the housing 102, respectively. In such examples, the second shell portion 120 may be defined by a rear major panel 121 and the remaining portions of the front, rear, top, and bottom panels 122, 123, 124, 125 of the housing 102.

Each shell may include a perimeter rim 210, 250 at the seam 200. The perimeter rims 210, 250 may abut each other when the luggage article 100 is closed. In some examples, each shell portion 110 or 120 may include an edge piece 200*a*, 200*b* defining its respective perimeter rim 210, 250. The edge pieces 200*a*, 200*b* may provide a desired aesthetic and/or functional characteristic of the luggage article 100. For instance, the edge pieces 196 may facilitate closing of the luggage article 100, as explained below. In embodiments in which the edge pieces are not contiguous with the walls of the housing 102, the edge pieces 200*a*, 200*b* may also trim the perimeter edges of the walls of the housing 102 to conceal sewing lines, and/or any imperfections and provide a clean appearance to, and/or a clean interface between, the first and second shell portion 110, 120.

The panels may be sized and shaped such that the luggage article 100 is taller than it is wide and wider than it is deep, such as that shown in at least FIG. 1. Other sizes and shapes of the housing 102 are contemplated, and the examples shown and described are for illustration purposes only. The luggage article 100 is illustrated as a hard side luggage case, but may be formed from many combinations of hard side and soft side material. For example, the housing 102 may be molded from hard side material, or formed from a combination of hard side material and soft side material (known as "hybrid" construction). In some examples, the housing 102 may be formed entirely from soft side material supported by a frame structure suitably configured to allow for the seam 200 as described herein. The hard side material may be a thermoplastic material (self-reinforced or fiber-reinforced), ABS, polycarbonate, polypropylene, polystyrene, PVC, polyamide, PTFE, or biaxially oriented polypropylene, among others. The soft side material may be nylon, canvas, polyester, leather, PVC, polypropylene, polyethylene, and/or PTFE, among others.

With continued reference to FIGS. 1-4, the luggage article 100 may include a plurality of handles such as one or more of the top carry handle 140*a*, side carry handle 140*b* and/or a retractable tow handle 130. For example, the luggage article 100 may include one or more top carry handles 140*a* connected to at least a portion of the top (e.g. 114 or 124) of the housing 102. A top carry handle 140*a* may be located on at least one of the top corners of the housing 102, and may be located on at least two of the top corners of the housing 102. Similarly, the luggage article 100 may include one or more side carry handles 140*b* connected to each of the side panels of the housing 102. A side carry handle 140*b* may be located on at least one side of the housing 102. As explained more fully below, the top carry handles 140*a* and the side carry handles 140*b* may be positioned to facilitate maneuverability of the luggage article 100 when being carried by a user. For instance, the top carry handles 140*a* and the side carry handles 140*b* may be positioned to facilitate carrying of the luggage article 100 around an obstacle, such as up a flight of stairs or the like.

When the luggage article 100 is loaded with user items, the weight of the article can be transferred from the handles into the sidewalls proximal to the handles. The downward pull on the luggage and the upward pull on the handle has a tendency to pull the sidewall of the luggage article 100 in the direction of the handle and away from the interior of the luggage article 100. This pull on the sidewall of the luggage article 100 is herein referred to as the burst tendency. In traditional luggage, this burst tendency would pull the adjacent walls of the luggage away from each other causing the engagement between those walls to fail. In accordance with various embodiments, at the seam 200, the luggage article 100 includes an engagable rim system 205 that is configured to resist the burst tendency.

In accordance with various embodiments, the engagable rim system 205 includes opposing peripheral rims (e.g. 210 and 250) that define the edge portions 200*a* and 200*b* respectively. In various examples, one of the rims includes a recess and the other rim includes a projecting flange. Additionally or alternatively, one of the rims 210 or 250 may include a second peripheral projecting flange 230. The second peripheral projecting flange 230 may be arranged to project beyond and be engaged behind (i.e. inwardly relative to the luggage article 100) the peripheral rim of the opposing shell. In accordance with one example, as shown in FIGS. 1-4C shell 220 includes peripheral rim 210. The opposing shell 210 includes peripheral rim 250. The peripheral rim 210 may include the recess 220 and peripheral rim 250 includes the projecting flange 260. The recess 220 and the projecting flange 260 are positioned relative to one another such that they are engage with one another when the case is closed. As the luggage article 100 is opened, the recess 220 and the projecting flange 260 are configured to separate from one another.

Figure 5B:
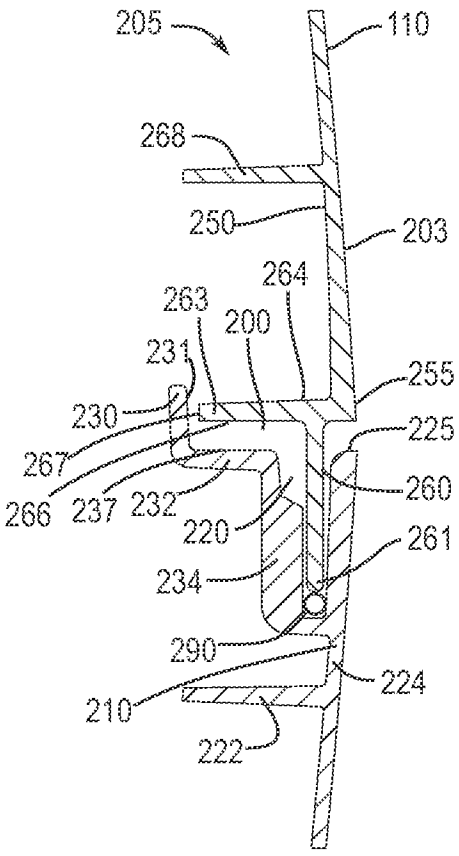
FIG. 5B is a cross-sectional view of the luggage article taken along line 5B-5B in FIG. 4A.
Figure 5A:
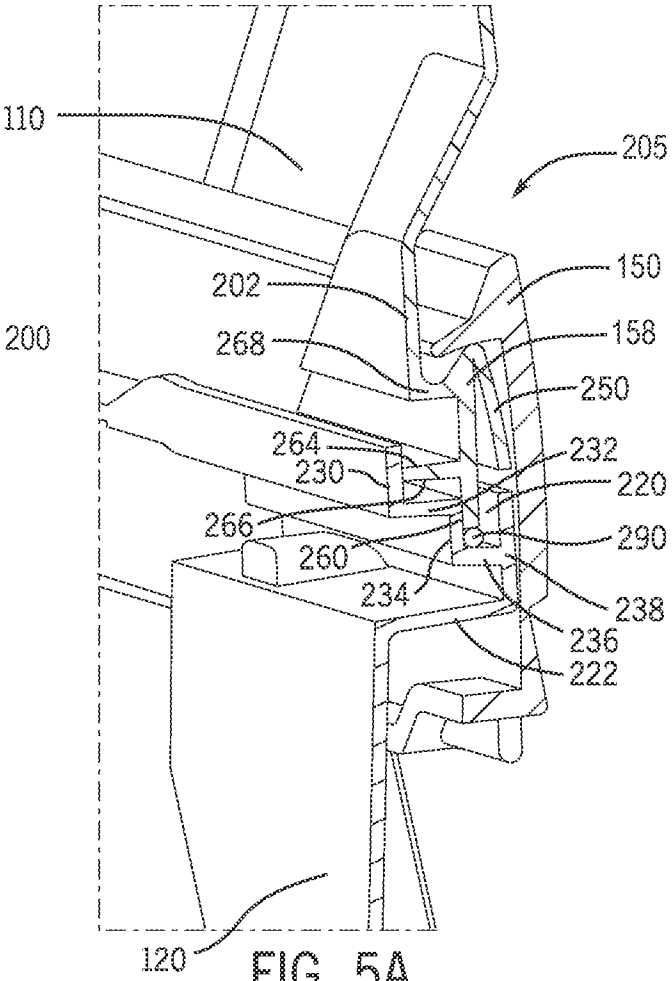
FIG. 5A is a cross-sectional view of the luggage article taken along line 5A-5A in FIG. 4A.

Referring to at least FIGS. 5A and 5B, the flange 260 may be defined by a suitable protrusion that is configured to engage a corresponding feature on the opposing rim such as the opposing rim 210. The flange 260 may be a protrusion that closely engages a corresponding recess, e.g., recess 220. In one example, the flange 260 is a cantilevered protrusion that extends from the lateral wall portion 263. The flange 260 may be a contiguous portion of the rim 250 having substantially the same wall thickness throughout. In various embodiments, the flange is at least three times longer than the wall thickness. In some embodiments, the flange is at least 5 times longer than its wall thickness. The flange 260 may vary in length around the perimeter of the rim 250. For example, the flange 260 may be shorter proximal to the latching mechanism (see FIG. 5A) and longer in regions absent the latching mechanism (See FIG. 5B). In other examples, however, the flange may be substantially the same length along the portions of the rim 250 from which it extends.

In various embodiments, the flange 260 extends from a lateral support 263. The lateral support 263 may form a surface 266 that faces the seam 200. In some embodiments, this surface 266 is generally parallel to a plane defined by the rim 250. In embodiments in which the rim 250 does not clearly define a plane, the surface 266 may be generally parallel to the major surfaces 111 or 121. The surface 266 may also contact or oppose an opposing surface 237 or opposing feature on the opposing rim 210. Additionally or alternatively, the lateral support 263 is defined by a flange or lateral rib that extends generally toward the interior 104 of the luggage article. In such an embodiment, the flange 263 is defined by the rim surface 266 on one side and interior surface 264 on its other side. The flange 266 may terminate in an interior edge 267.

In various embodiments, the flange 260 extends from the lateral support 263 along a central portion of the lateral support 263 defining rim surfaces 266 and 255 on either side of the flange 260. The lateral support 263 may extend inwardly from an outer facia wall 203 on rim 250 The rim surface 255 may be located to face or receive an opposing flange on the opposing rim 250. In one example, the rim surface 255 is about the same thickness as the outer facia wall 224 of the rim 250. This configuration allows closing of the shells 110 and 120 such that the rim surface 255 receives the outer facia wall 224 forming a substantially smooth profile from the outer facia wall 224 on rim 210 to the outer facia wall 203 on rim 250.

As indicated above, the rim 250 may vary its profile around the periphery of the shell 110. For example, the outer facia wall 203 on rim 250 may vary for defining a substantially continuous surface profile as shown in FIG. 5B with the rim surface 255 to defining a catch 158 for receiving the buckle 150 by defining an overhanging wall 252 as shown in FIG. 5A. In this manner, the rim 250 may define multiple types of engagement feature for connecting one shell to the other.

As illustrated in FIGS. 5A and 5B, the rim 250 may have the lateral support 263 discussed above defining an inwardly directed flange along with a second parallel flange 268 extending inwardly from the rim 250 toward the interior 104 of the luggage article 100. The first and second inwardly extending flanges 263 and 268 may define a C-shaped channel that opens inwardly into the shell 110. This inwardly facing C-shape channel provides reinforcement to the rim edge better than the conventional arrangements. Further the C-shape channel and support 263 provides a larger and stronger abutting rim surface 266. The larger and stronger abutting rim surface 266 allows for flexibility of the features and structures that can depend therefrom. For example, the flange 260 can project from the surface. In other embodiments, the recess 220 can extend from the channel surface proximal to the seam. In yet other embodiments, the second flange can extend from the end of the support 263. In some embodiments, the C-shaped channel extends around only a portion of the rim. For example, the C-shaped channel extends from recess 152*a* to recess 152*b* (See FIG. 3). In other embodiments, the C-shaped channel extends around substantially the entire rim 250. The C-shaped channel may also include ribs that extend across the channel providing support between flanges 263 and 268.

Again referring to at least FIGS. 5A and 5B, recess 220 may be defined by a channel suitable to receive the flange 260. The recess 220 may be a channel that closely receives the flange 260. In one example, the recess 220 is a slot that extends generally perpendicularly from a rim surface 237. The recess 220 may be a contiguous portion of the rim 210. The recess 220 may have a width that is slightly larger than thickness of the flange 260 allowing for a close fit between the two structural elements. In various embodiments, the recess 220 has a width that is less than three times the thickness of the flange 260. In some embodiments, the recess 220 has a width that is less than two times the thickness of the flange 260. The recess 220 may vary in depth or width around the perimeter of the rim 210 accommodating different profiles, thicknesses or structures of the flange 260.

In various embodiments, the recess 220 extends from a lateral support 232, which defines the rim surface 237. The rim surface 237 may face the seam 200. In some embodiments, this rim surface 237 is generally parallel to a plane defined by the rim 210. In embodiments in which the rim 210 does not clearly define a plane, the rim surface 237 may be generally parallel to the major surfaces 111 or 121. The rim surface 237 may also contact or oppose an opposing surface 266 or opposing feature on the opposing rim 250. Additionally or alternatively, the lateral support 232 is defined by a wall, lateral rib, protrusion, or flange that extends generally toward the interior 104 of the luggage article. In one embodiment, the lateral support 232 may terminate as the second flange 230. In another embodiment, the lateral support 232 may terminate in an interior edge.

As discussed above, the rim 210 may also have the outer facia wall 224. The recess 220 may be defined by a wall 236 extending from the outer facia wall 224 inwardly. In such an embodiment, the wall 236 can define the base of the recess 220. The wall may then extend toward the seam defining an interior recess wall 234. This interior recess wall 234 may be thicker for flange support or may have interior ribs that intersect it providing greater support. This interior recess wall 234 than may turn inwardly defining the lateral support 232. As indicated above, in some embodiments, a flange 230 may extend from the lateral 232. The outer facia wall 224 may include end 225 suitable to face or engage an opposing rim surface 255. The end 225 may form a thickened portion of the wall 224 suitable to engage the opposing surface 255. As indicated above, this configuration allows closure of the shells 110 and 120 such that the rim surface 255 receives the outer facia wall 224 forming a substantially smooth profile from the outer facia wall 224 on rim 210 to the outer facia wall 203 on rim 250.

In some embodiments, the rim 210 also includes a seal 290. In one example, the recess 220 may receive the seal 290 along the base 236 thereof. In this manner, when the recess 220 receives the flange 260 as the luggage article 100 closes, the flange 260 engages the seal 290 forming a sealed engagement between the shells 110 and 120. As indicated above, the recess 220 may be a slot that is less than three times or less than two times the thickness of flange 260. Preferably, the slot is only slightly wider than the thickness of flange 260 to allow for tolerances while still being able to receiving the flange 260 easily. The seal 290 can be any suitable size. For example, the seal may be sized to be as thick as or thicker than the flange 260 to being the same size as or smaller than the width of the slot 220. The seal can be any suitable material. For example, the seal can be silicone, rubber, polymer, or composite material.

As illustrated in FIGS. 5A and 5B, the rim 210 may have the lateral support 232 discussed above defining an inwardly directed flange along with a second parallel flange 222 extending inwardly from the rim 210 toward the interior 104 of the luggage article 100. The first and second inwardly extending flanges 232 and 222 may define a channel that opens inwardly into the shell 110. In some embodiments, the channel extends around only a portion of the rim. For example, the channel extends from recess 154*a* to recess 154*b* (See FIG. 2). In other embodiments, the channel extends around substantially the entire rim 210. The channel may also include ribs that extend across the channel providing support between flanges 232 and 222.

Again as illustrated in FIGS. 5A and 5B, the projecting flange 230 may be defined by a suitable protrusion that engages or otherwise is configured to engage with an inner portion of the opposing rim. For example, if the opposing rim is rim 210, the flange 230 may extend pass and be configured to engage with an interior end of support 232. If the opposing rim is rim 250, as shown in FIGS. 5A and 5B, the flange 230 may extend pass and be configured to engage with an interior end 267 of support 266. While it is explained herein and appreciated that the flange 230 can extend from a rim having a recess or a rim having another flange, further discussion will refer to the flange 230 extending from a rim having a recess as merely an example, but with the understanding the each of the example and embodiments can apply to either configuration unless otherwise stated.

In accordance with various embodiments, the projecting flange 230 defines an outwardly facing surface 231 that is proximal to and abuts the rim of the opposing shell (rim 250 as shown in FIG. 5B and specifically end 267 shown as well). Preferably, the flange 230 forms the innermost (with respect to the luggage article 100 and its interior 104) portion of either rim. Specifically the flange 230 can be cantilevered into the interior 104 itself. For example, the flange 230 can be free such that it does not engage in another recess, slot, groove or similar structure on the opposing rim. Positioning the secondary flange 230 as an inner most flange allows the flange 230 to engage the structure of the entire opposing rim. This is beneficial when resisting the burst tendency of the luggage article since the flange 230 translates the force that would cause bursting to the entire edge of the opposing rim allowing for improved distribution of the forces and decreased tendency to burst.

Figure 2:
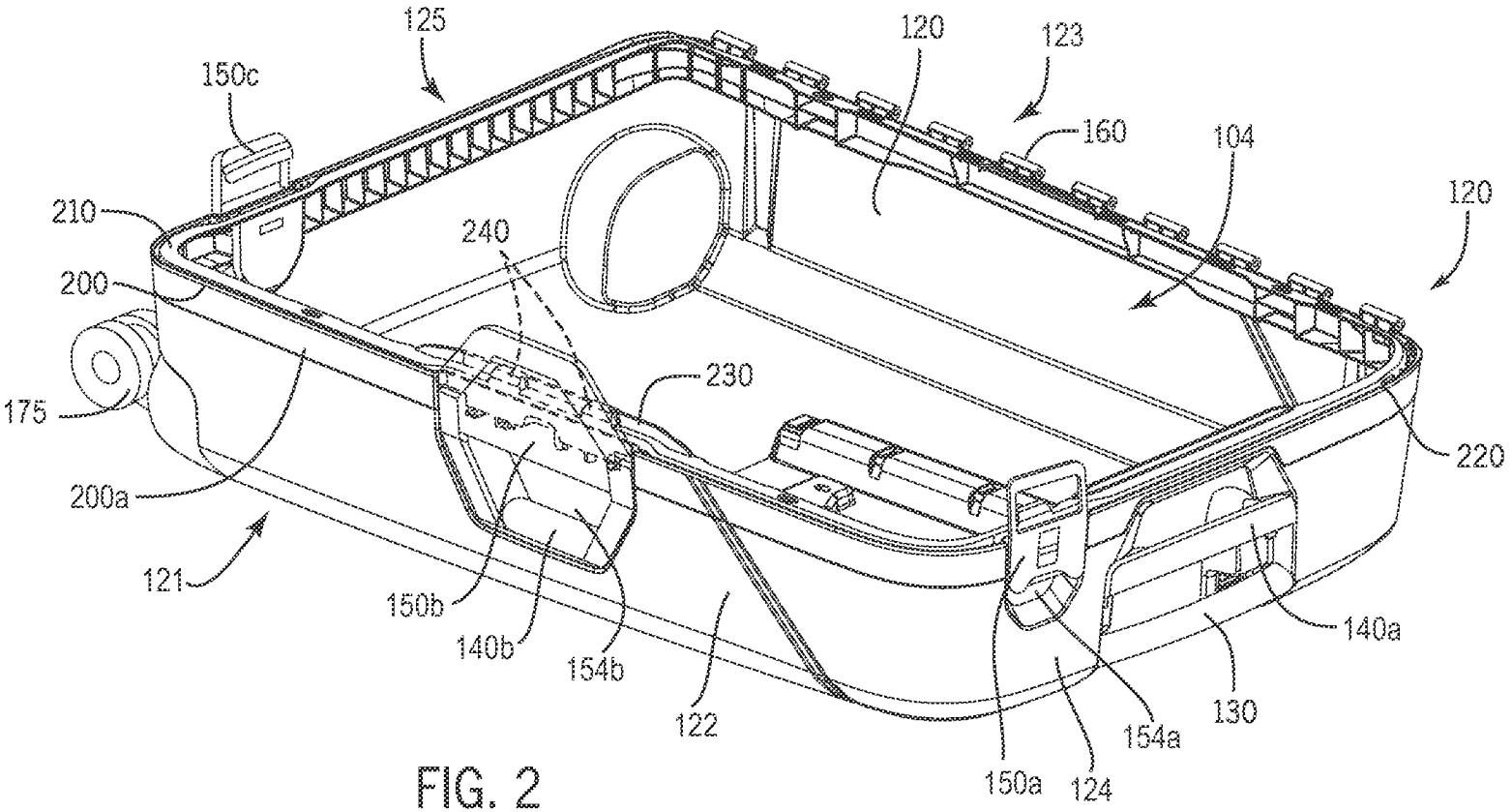
FIG. 2 is an isometric view of the rear shell of the luggage article of FIG. 1 and showing a retractable tow handle in a retracted position.

As the projecting flange 230 aids in reducing the burst tendency of the luggage article 100, the projecting flange 230 may be limited to extending from a small portion or along discrete selected sections of the peripheral rim. For example, the flange 230 may extend from the rim surface or support flange (e.g. support 232) proximal to regions where a handle is located. In one example, the flange 230 extends from support 232 proximal to handle 140*a* and 140*b* to provide the additional stiffness and support in these regions prevent outward bursting apart of the abutting two shells 110, 120 at the seam. At these locations, the handles are under load and as such, the forces that cause bursting tend to be localized at these regions. Locating the projecting flange 230 proximal to these regions allows for distribution of these forces while minimizing the presence or impact of the additional flange on the ability to close or use the luggage article. Locations of the rim away from the handle can be free of the flange 230. The flange 230 can also be located on the rim associated with the shell having a lift handle (e.g. 140*a*, 140*b*) on it. Thus, the forces from the handle are exerted through the same shell and rim and to the flange forming a part thereof. For example, as shown in FIG. 2, the shell 120 includes the lift handles 140*a*, 140*b* and the flange 230. However, it is appreciated that in other embodiments, the flange 230 can be located at along portions of the rim at locations other than those proximal to the handle. For example, the flange 230 can extend around the whole rim. In another example, the flange 230 can extend along the rim along the length of the top, bottom, or side surfaces. In various examples, the projecting flange 230 may be located along a plurality of selected discrete sections of the rim.

In embodiments on which the flange 230 is located on the second peripheral rim 250, the flanges project generally perpendicularly from the lateral extension 232. The flange 230 may extend from the lateral extension 232 inwardly of the rim 210 such that the flange 230 would engage or otherwise interfere with an inner portion the rim 210 in response to an outward force that would increase the burst tendency.

In embodiments on which the flange 230 is located on the rim 210, the flanges 230, 260 project generally perpendicularly from the lateral extension 263. The flange 230 extends from the lateral extension 263 inwardly of the rim 250 such that the flange 230 engages or otherwise interferes with an inner portion of the rim 250 in response to an outward force that would increase the burst tendency.

In some embodiments, the projecting flange 230 projects along a portion of a mid-point region of a long side of the peripheral rim. Additionally, or alternatively the projecting flange 230 projects along a portion of a mid-point region of a short side of the peripheral rim. While in some embodiments, these may be the locations of handles, these are also the locations where forces can cause the greatest amount of deflection and burst. Thus, regardless of the presence of handles, these locations can benefit from the added support of flange 230.

Figure 4A:
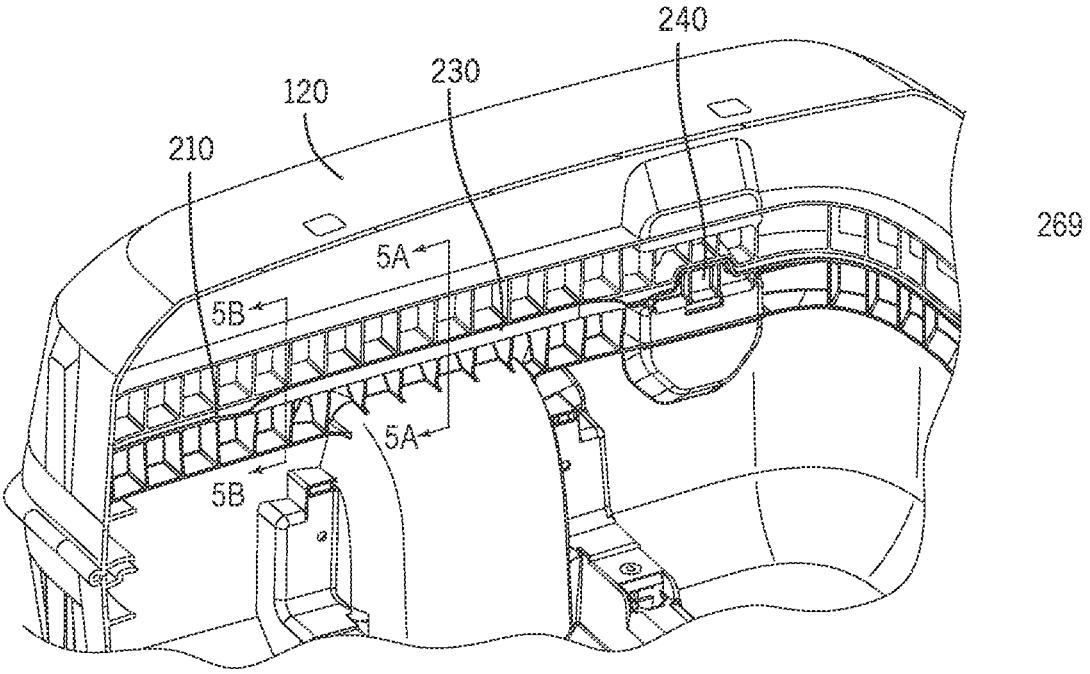
FIG. 4A is an isometric cross-section view of the luggage article taken along cross-section 4A-4A of FIG. 1.
Figure 4B:
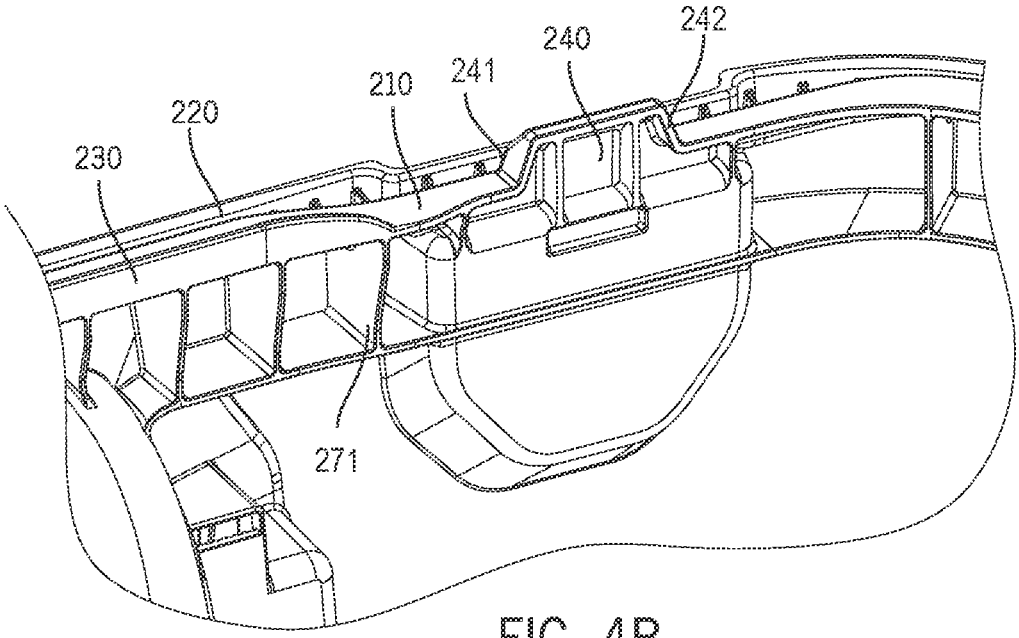
FIG. 4B is an isometric detailed view of only the rear shell of the luggage article shown in FIG. 4A.
Figure 4C:
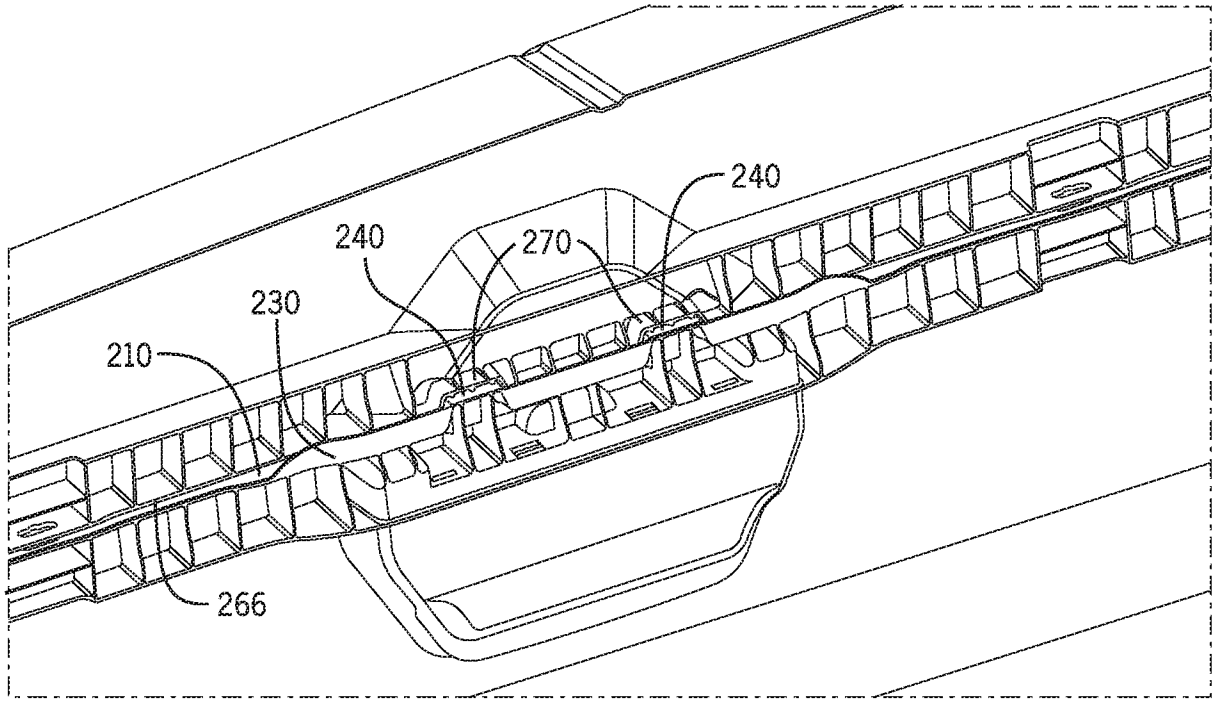
FIG. 4C is an isometric cross-section view of the luggage article taken along cross-section 4C-4C of FIG. 1.

As illustrated in FIGS. 4A-4C, one or both of the rims may have one or more discrete protrusions 240 extending therefrom. Additionally, the opposing rim may include recesses 270 sized and positioned to receive the discrete protrusions 240. In some embodiments, the protrusions 240 can be defined as discrete sections of flange 230. In other embodiments, the protrusions 240 can form a part of (e.g. a structurally thicker part of) flanges 230. In other embodiments, the protrusions 240 are standalone features discrete from flanges 230. The protrusions 240 may include a structure that defines a thickness from an outer portion 241 to a portion 242 that thicker than that wall thickness of the flange 260 or the width of the recess 220. For example, the protrusion 240 thickness may be between 1/10 of its length along the rim and the same as its length along the rim. Although it should be appreciated, greater, and lesser thickness are contemplated herein. In another example, the protrusion 240 thickness may be greater than the thickness of the flange 230.

The protrusions 240 are configured to engage in corresponding recesses 270 in the other shell in the regions of at least one of locks or handles on the shells. As such, the recess 270 may include both shape and size to tightly receive the protrusions 240. In various embodiments, these protrusions may be located proximal to locking mechanisms or handles. This structure further interlocks the shells when fitted together in the regions of the locks or handles improving impact resistance and bust resistance.

In some embodiments, as shown for example in FIG. 4C, the protrusions 240 can be contiguous with and form a portion of the flange 230. In such embodiments, the protrusion 240 may engage an opposing recess 270 with the flange 230 remaining interior to the opposing rim. Such a structure may be suitable at the handle location that can also comprise a latch in the same location as shown. However in other locations such as those shown in FIGS. 4A and 4B, the protrusion can be present without a flange 230, such as at locations in which there is a latch but no handle.

The luggage article 100 illustrated in FIG. 1 is an upright spinner hard side case but may be any type of luggage, including a soft side spinner case, a container, or other suitable articles having opposing closable sides having a seam 200 with an engagement rim along the seam 200 of the closable sides. The seam 200 may extend between the first 110 and second shell portion 120 crossing along the top, bottom, front and rear surfaces of each of the shells of the luggage article 100. In one example, the seam 200 extends in a straight line substantially parallel to the major panels 111 and 121. In other examples, the seam 200 may extend in a different manner on any one or more of the faces in any suitable manner to close opposing shells. In further examples, the seam 200 may curve (once or multiple times), jog, form a serrated shape, or extend at an angle relative to the non-traversed faces of the luggage article 100.

Figure 3:
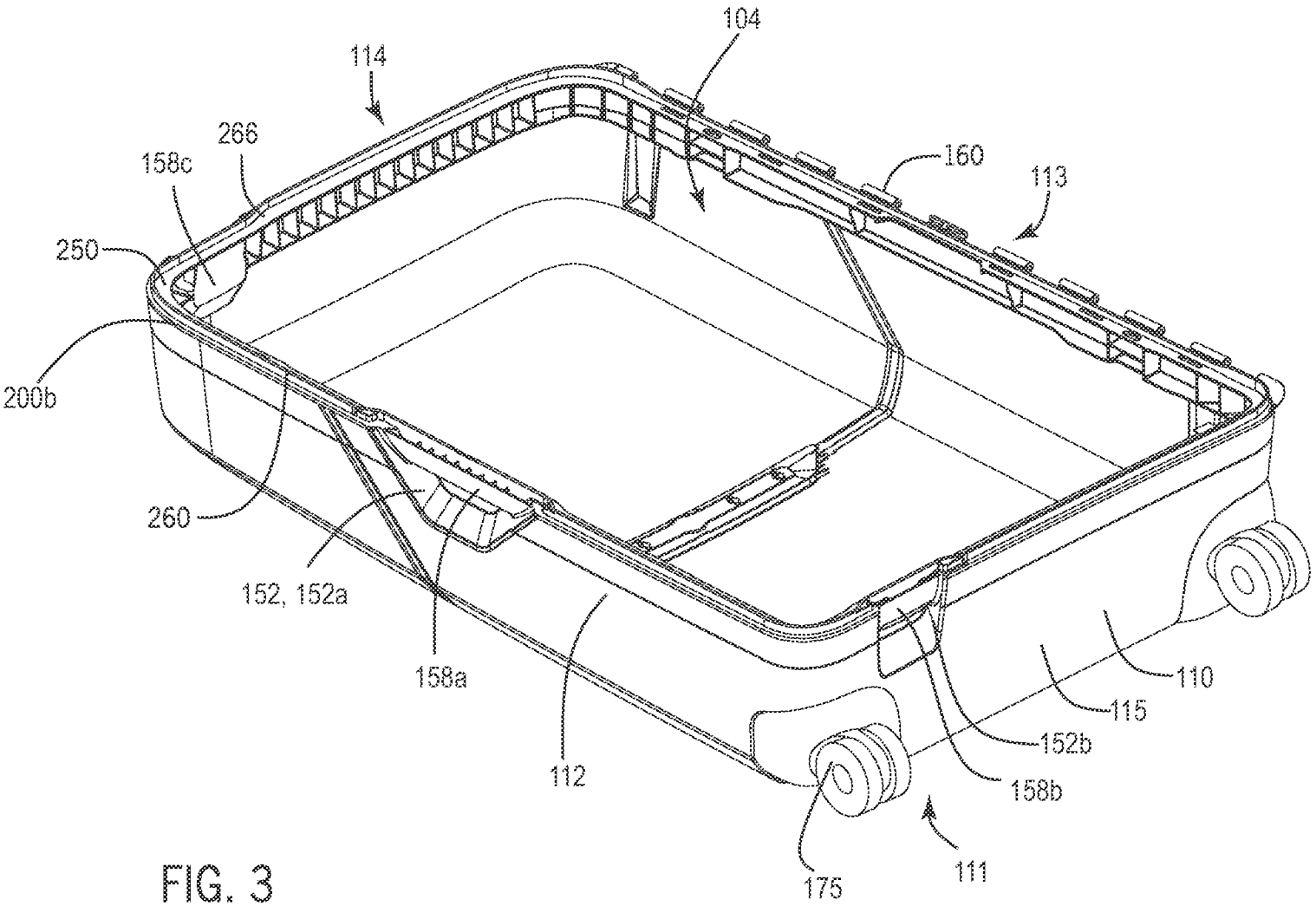
FIG. 3 is an isometric view of the front shell of the luggage article of FIG. 1 and showing a retractable tow handle in an extended position.

Referring to at least FIGS. 1-3, the luggage article 100 may be moved between a closed configuration (see FIGS. 1, 4A and 4C) and an open configuration. In the closed configuration, the first and second shell portion 120 may be positioned adjacent to each other forming the seam 200, and in one example have the respective perimeter rims 210, 250 of the seam 200 in engagement, to enclose a user's belongings within the internal storage volume 104 of the luggage article 100. In one example, the respective perimeter rims 210, 250 may each, along at least a portion of the perimeter, have a corresponding shape to the other to fit together and form corresponding overlapping or interlocking structures. The corresponding shapes may extend along the entire length of the perimeter rims 210, 250, or along a portion of each rim 210, 250, or change shape size or other characteristic along more than one portion of each rim 210, 250.

As shown in FIG. 2, the hinge 160 may be defined between the first and second shell portion 110, 120, such as on the rear panels 112, 122 of the first and second shell portions 110, 120, along at least a portion of the seam 200. The hinge 160 may include many configurations arranged to allow selective positioning, such as in one example by rotation about an axis of the hinge 160, of the first shell portion 110 relative to the second shell portion 120 from fully closed to fully open. For example, the hinge 160 may be defined by opposing edges of rear sides 113, 123 along their respective lengths or portions of their respective lengths. The hinge 160 may be connected to the perimeter rim 210 of the first shell portion 110, and the other opposing hinge 160 may be connected to the perimeter rim 250 of the second shell portion 120. The hinge 160 may be connected either directly or indirectly through one or more intermediate elements to respective perimeter rims 210, 250. In some examples, depending on the particular application, the hinge 160 may include any number or combination of a fabric strip, a strip of rubber, a piano hinge, a living hinge, spaced-apart discrete hinges, a zipper structure, an articulating joint made of elastomeric material, or other suitable structures that allow relative movement between the first 110 and second shell portion 120. Such relative movement may include pure rotation about a fixed pivot axis, or may include rotation about a pivot axis combined with translation or other relative movement.

Referring to FIGS. 1-4, the luggage article 100 may include one or more support members 170 to support the luggage article 100 against a support surface (e.g., against the ground). The support members 170, which may be a foot, a fixed wheel assembly, a spinner wheel assembly, or any combination thereof, may be associated with any suitable panel of the housing 102, such as in at least one example connected to at least the bottom sides 115,125. As shown, the luggage article 100 may include four support members 220. In such examples, the luggage article 100 may include two support members 170 connected to each of the first shell portion 110 and the second shell portion 120. The luggage article 100 may be tilted by a user onto two of the support members 170 for traversal across a support surface.

Referring to FIGS. 1 and 2, the tow handle 130 may be movable between a retracted position (see FIG. 2) and an extended position. As shown in FIG. 2, in the retracted position, the grip of the tow handle 130 may be positioned near or adjacent to the housing 102, such as being at least partially retracted into or towards the housing 102. Retraction of the tow handle 130 into the retracted position may reduce an overall dimension of the luggage article 100. For instance, the tow handle 130 may be moved to the retracted position to reduce an overall size of the luggage article 100 to facilitate storage and/or positioning of the luggage article 100 in a relatively smaller space. Extension of the tow handle 130 into the extended position may allow a user to traverse the luggage article 100 across a support surface as desired. For instance, the user may push, pull, spin, tilt, or otherwise maneuver the luggage article 100 across a support surface through user manipulation of the tow handle 130.

Referring to FIGS. 1-4C, the luggage article 100 may include a closure mechanism 150 to selectively secure the first shell portion 110 and the second shell portion 120 together. The closure mechanism 150 may be positioned along or adjacent to the seam 200 between the first shell portion 110 and the second shell portion 120 to engage each of the shell portions 110, 120 and allow selective actuation for opening and closing of the luggage article 100. The closure mechanism 150 may be a discrete mechanism, such as latches 150*a* or 150*b*, or may be a continuous-closure mechanism positioned along at least a part of the length of the seam 200, such as a zipper.

In an open configuration, the closure mechanism 150 is disengaged along a length of the seam 200 sufficient to allow the first shell portion 110 and the second shell portion 120 to pivot relative to each other to any amount from partially open to fully open. In one example, where the closure mechanism is a zipper, the closure mechanism is disengaged along the entirety of the front sides 112, 122; the top sides 114, 124; and the bottom sides 115, 125. This allows for the first and second shell portion 110, 120 to move relative to one another about the hinge 160. In a closed configuration, the closure mechanism 150 is engaged along at least a portion of the length of the seam 200 to limit relative movement between the first shell portion 110 and the second shell portion 182.

In accordance with various examples, one or more latches 150*a* or 150*b* may be spaced along the seam 200. As shown in FIG. 2, the closure mechanism 150 may include a discrete single latch 150*b* located on the front side 122 of shell 120. In this manner, the closure mechanism 150 may be positioned on the major face opposite the hinge 160. Additionally or alternatively, in various examples, the closure mechanism 150 may include a discrete single latch 150*a* located on the top side 124 of shell 120. In this manner, the closure mechanism 150 may additionally or alternatively be positioned on the major face other than the face opposite the hinge 160.

In some examples, the closure mechanism 150 may be positioned within one or more recesses 152, 154 defined in the front sides 112, 122 of the housing 102. More specifically, recessed portions 152 may be defined along the seam 200 in both the first and second shell portions 110,120 such that the recessed portions 152, 154 combine to define the recess 156 when the first and second shell portion 110, 120 are connected together. When the luggage article 100 is closed, the latch 150 may be positioned within the recessed portions 152, 154 of the first and second shell portions 110, 120. When the luggage article 100 is opened, the latch 150 may disengage and be positioned at least partially within the recessed portion 152, 154 of one of the first and second shell portions 110, 120. In such examples, when the luggage article 100 is closed, the latch 150 may extend into the recessed portions 152, 154 of the other of the first and second shell portions 110, 120 to secure the first and second shell portions 110, 120 together. In some examples, portions of the latch 150 may separate from one another when the luggage article 100 is opened, with at least one portion of the latch 150 positioned within the recessed portion 152 of the first shell portion 110 and at least another portion of the latch 150 positioned within the recessed portion 154 of the second shell portion 120. When the luggage article 100 is closed, the portions of the latch 150 may combine to lock the first and second shell portion 110, 120. In some examples, the recess 156 may be arranged such that the latch 150 sits generally flush, below flush, or slightly above flush, with the exterior of the housing 102 when the luggage article 100 is positioned in its closed configuration. This helps reduce the risk that the latch 150 is caught or snagged during shipment. While the buckle portion of latch 150 may be connected to one shell such as shell 120 as shown, the catch portion of latch 150 may be integrally formed in the other shell such as shell 110 as shown. Both the buckle and the catch may be located within the recess 156, with the catch recessed within recess portion 152.

The luggage article 100 may be formed from a variety of materials and means. For example, the housing 102, among others, may be formed from a thermoplastic material (self-reinforced or fiber reinforced), ABS, polycarbonate, polypropylene, polystyrene, PVC, polyamide, biaxially oriented polypropylene, and/or PTFE, among others. In some examples, the tow handle 232, among others, may be extruded from aluminum or other similar metal. In addition, the housing 102 may be formed from fiber reinforced epoxy, resin, or other similar material. The luggage article may be formed or molded in any suitable manner, such as by plug molding, blow molding, injection molding, extrusion, casting, or the like. As noted above, the luggage article may be formed from soft side material and/or hard side material. Exemplary materials are noted above.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims. Any suitable form of fabrication can be utilized to form the various structures discussed herein. For example, each of the peripheral rim structures including flanges, slots, or other features can all be integrally moulded (as part of shell or as a frame). While an injection moulded luggage articles may be a preferred embodiment it should be noted other suitable methods of manufacturing, forming, or structuring the luggage articles can also be used. For example, the luggage articles can also be press-formed cases, framed split cases, soft-sided cases or the like.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. Luggage case comprising:

a first shell hingedly connected together with a second shell, the first shell having an integrally molded first peripheral rim and the second shell having an integrally molded second peripheral rim that abut together in a closed configuration, wherein:

the first peripheral rim includes an integrally molded recess;

the second peripheral rim includes an integrally molded first projecting flange that is engaged within the recess when the first shell and the second shell are in the closed configuration;

the first shell includes an integrally molded second projecting flange that is arranged to project beyond and be engaged inwardly of a distal edge of a lateral wall portion of the peripheral rim of the opposing shell wherein the second projecting flange is positioned behind the distal end of the lateral wall portion relative to the opposing shell, and wherein the lateral wall portion is a straight lateral wall portion.

2. The luggage case of claim 1, wherein the first projecting flange extends around a majority of the second peripheral rim.

3. The luggage case of claim 1, wherein the second projecting flange projects along only a portion of the peripheral rim.

4. The luggage case of claim 1, wherein the second projecting flange projects along a portion of a mid-point region of a long side of the peripheral rim.

5. The luggage case of claim 1, wherein the second projecting flange projects along a portion of the peripheral rim proximal to a carry handle of the case.

6. The luggage case of claim 1, wherein the second projecting flange is disposed and projects more inwardly, relative to the case, than the first projecting flange.

7. The luggage case of claim 1, wherein the second projecting flange includes an outwardly facing surface that is proximal to and faces a lateral side flange extending laterally inwardly from the second peripheral rim of the shell.

8. The luggage case of claim 1, wherein the second projecting flange includes an outwardly facing surface that is proximal to and abuts the peripheral rim of the opposing shell.

9. The luggage case of claim 1, wherein the first peripheral rim and the second peripheral rim each include lateral surfaces from which the flanges project generally perpendicularly.

10. The luggage case of claim 1, wherein the first peripheral rim includes a lateral surface into which the recess is formed, with the lateral surface opposing a generally parallel lateral surface formed on the second peripheral rim when in the closed configuration.

11. The luggage case of claim 1, wherein the first peripheral rim includes a seal provided in a base of the recess and configured to abut the end of the first projecting flange when in the closed configuration.

12. The luggage case of claim 1, wherein the first peripheral rim or the second peripheral rim includes discrete protrusions extending therefrom that are configured to engage in corresponding recesses defined in the other shell in the regions of at least one of locks or handles on the shells.

13. The luggage case of claim 1, wherein the first peripheral rim includes at least two generally parallel flanges extending inwardly from and around the first peripheral rim forming a C-shape that opens inwardly into the first shell.

14. The luggage case of claim 1, wherein the second peripheral rim includes at least two generally parallel flanges extending inwardly from and around the second peripheral rim forming a channel that opens inwardly into the second shell.

15. The luggage case of claim 1, wherein the second projecting flange is the innermost portion of either rim.

16. The luggage case of claim 1, wherein the lateral wall portion is a lateral flange that extends toward an interior of the luggage case from the peripheral rim.

17. The luggage case of claim 1, wherein the lateral wall portion is substantially perpendicular to the peripheral rim from which it extends.

18. The luggage case of claim 1, wherein the second projecting flange is substantially parallel to the peripheral rim from which it extends.

* * * * *